United States Patent [19]

Jacobsson

[11] 4,386,508

[45] Jun. 7, 1983

[54] APPARATUS FOR SELECTIVE POSITIVE FEEDING OF A PLURALITY OF YARNS TO A STRIPING KNITTING MACHINE

[75] Inventor: Kurt A. G. Jacobsson, Ulricehamn, Sweden

[73] Assignee: Aktiebolaget IRO, Ulricehamn, Sweden

[21] Appl. No.: 269,061

[22] PCT Filed: Oct. 31, 1980

[86] PCT No.: PCT/EP80/00124

§ 371 Date: May 18, 1981

§ 102(e) Date: May 18, 1981

[87] PCT Pub. No.: WO81/01301

PCT Pub. Date: May 14, 1981

[30] Foreign Application Priority Data

Oct. 31, 1979 [SE] Sweden ..... 7909039

[51] Int. Cl.[3] ..... D04B 15/48

[52] U.S. Cl. ..... 66/132 T; 66/163; 66/158

[58] Field of Search ..... 66/125, 132 R, 132 T, 66/158, 160, 161

[56] References Cited

U.S. PATENT DOCUMENTS

| | | | |
|---|---|---|---|
| 3,418,831 | 12/1968 | Nance | 66/132 |
| 4,137,731 | 2/1979 | Jacobsson | 66/132 |
| 4,259,851 | 4/1981 | Jacobsson | 66/132 T |
| 4,259,851 | 4/1981 | Jacobsson | 66/132 T |

FOREIGN PATENT DOCUMENTS

| | | | |
|---|---|---|---|
| 2836716 | 8/1979 | Fed. Rep. of Germany | 66/132 |

*Primary Examiner*—Ronald Feldbaum

*Attorney, Agent, or Firm*—Flynn, Thiel, Boutell & Tanis

[57] ABSTRACT

This invention relates to an apparatus for selective positive feeding of a plurality of yarns (Fa–Fd) to striping knitting machines, comprising a plurality of yarn feeding units (1), each having a number of yarn feeding devices. The invention proposes to use a single electromagnet (9) in each yarn feeding unit to move the yarn control elements (*7'a–7'd*) of all yarn feeding devices from their feeding to their non-feeding positions by means of a uni-directional coupling between the electromagnet (9) and the control elements (*7'a–7'd*) and to move the control elements in the reverse direction by means of an increase in yarn tension when the yarn (Fa–Fd) is being knitted into the fabric.

5 Claims, 5 Drawing Figures

APPARATUS FOR SELECTIVE POSITIVE FEEDING OF A PLURALITY OF YARNS TO A STRIPING KNITTING MACHINE

The invention relates to an apparatus for selective positive feeding of a plurality of yarns to a horizontal striping knitting machine in accordance with the preamble of claim 1.

A known apparatus of this kind is disclosed in GB-A No. 2 035 389 (corresponding to West German application No. P 29 39 803.6, Italian application No. 26 235a/79, Japanese application No. 54-128415, South Korean application No. 34 08/79, Taiwanese application No. 6812220, U.S. Ser. No. 81,540 of 79). In this prior apparatus, when used in connection with a striping knitting machine, at least one electromagnet is associated with each yarn feeding device. The magnet is energized to bring the yarn associated with its yarn feeding device into its first position and de-energized to bring the yarn into its second, non-feeding position. Alternatively, two electromagnets can be associated with each yarn feeding device, one of them being energized for moving the yarn into its first position and the other to move it back into the second position. Thus, each set of yarn feeding devices included in one positive yarn feeding unit has either the same number of electromagnets or twice this number. In a striping knitting machine, a large number of positive yarn feeding units is required, which in turn calls for a far higher number of magnets. This makes the device not only mechanically complex, but requires a very complicated electrical or electro-mechanical control system for all the magnets. Thus, while the prior apparatus largely avoids the previous drawbacks of positive yarn feeding in striping machines, in particular overflow of yarn from the positive feeding devices and frequent yarn breakages, by controlling the positive yarn feeding devices in such a way that the yarns are disengaged from the positive feeding elements prior to their being taken out of the knitting position, it still has the disadvantage of mechanical and electrical complexity.

It is known, (e.g. from U.S. Pat. No. 3,950,966) to control the position of the yarn relative to the positive feeding elements of a yarn feeder by the degree of tension in the yarn. This is usually accomplished by using a spring-loaded, pivotable eyelet, which moves the yarn, when under no or low tension, to a position, in which no positive feed takes place, and which is pivoted by an increase in the yarn tension to a position in which the yarn is engaged by the positive yarn feeding element. By using this type of yarn control in connection with a yarn feeding system for striping knitting machines, it is not possible to move the yarns out of their positive feeding positions before they are taken out of their knitting positions. If, however, the yarns are at the same time taken out of their knitting positions and out of their positive feeding positions, the problems of overflow feeding and yarn breakage reoccur.

The task underlying this invention is to improve the apparatus of the type defined above to make it mechanically and, above all, in its electrical control, less complicated and more reliable.

This task is solved by the features of the characterizing portion of claim 1.

The apparatus according to the invention requires only one electromagnet for each set of positive feeding devices. Such a single magnet is mechanically very simple and, above all, easy to control electrically. The advantage of each yarn being disengaged from the positive feed before it is taken out of its knitting position is maintained. The return to the positive feed position is accomplished in a simple and known way by increase of tension. No problems are caused by simultaneously engaging the positive feed and returning the yarn to the knitting position. The apparatus according to the invention is inexpensive to manufacture and is small enough to be fitted on any striping machine. It is also easy to monitor.

Claim 2 is directed to a mechanically simple unidirectional connection between the magnet and the yarn control elements.

Claim 3 covers a further advantageous detail of said connection.

Claims 4 and 5 are directed to a simple and reliable monitoring circuit for the apparatus according to the invention.

The invention will now be described in connection with the drawings, which show, by way of example, one embodiment of the invention. In the drawings:

FIG. 1 is a schematic time representation of the disengagement from positive feed of a first yarn and the application of positive feed to a second yarn;

FIG. 2 schematically shows a positive yarn feeding unit of an apparatus according to the invention comprising four positive yarn feeding devices of the tape feeder type;

Figure 1:
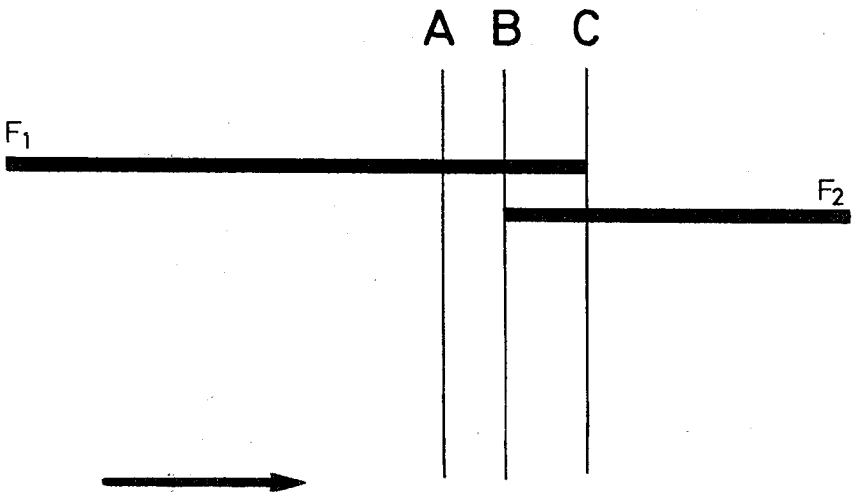

The schematic time diagram in FIG. 1 shows that a first yarn $F_1$, e.g. of blue colour, being positively fed, is taken out of knitting at a point of time C. A second yarn $F_2$, e.g. of yellow colour, is brought into knitting at a point of time B. The yarn $F_1$ is disengaged from the positive feed prior to its being taken out of knitting, namely at a point in time A. All of said points in time A, B and C are preferably within the time period during which the needle free portion of the knitting cylinder (which most knitting machines for striped fabrics have), passes the respective knitting station, where the change from one yarn to another is to take place.

Figure 2:
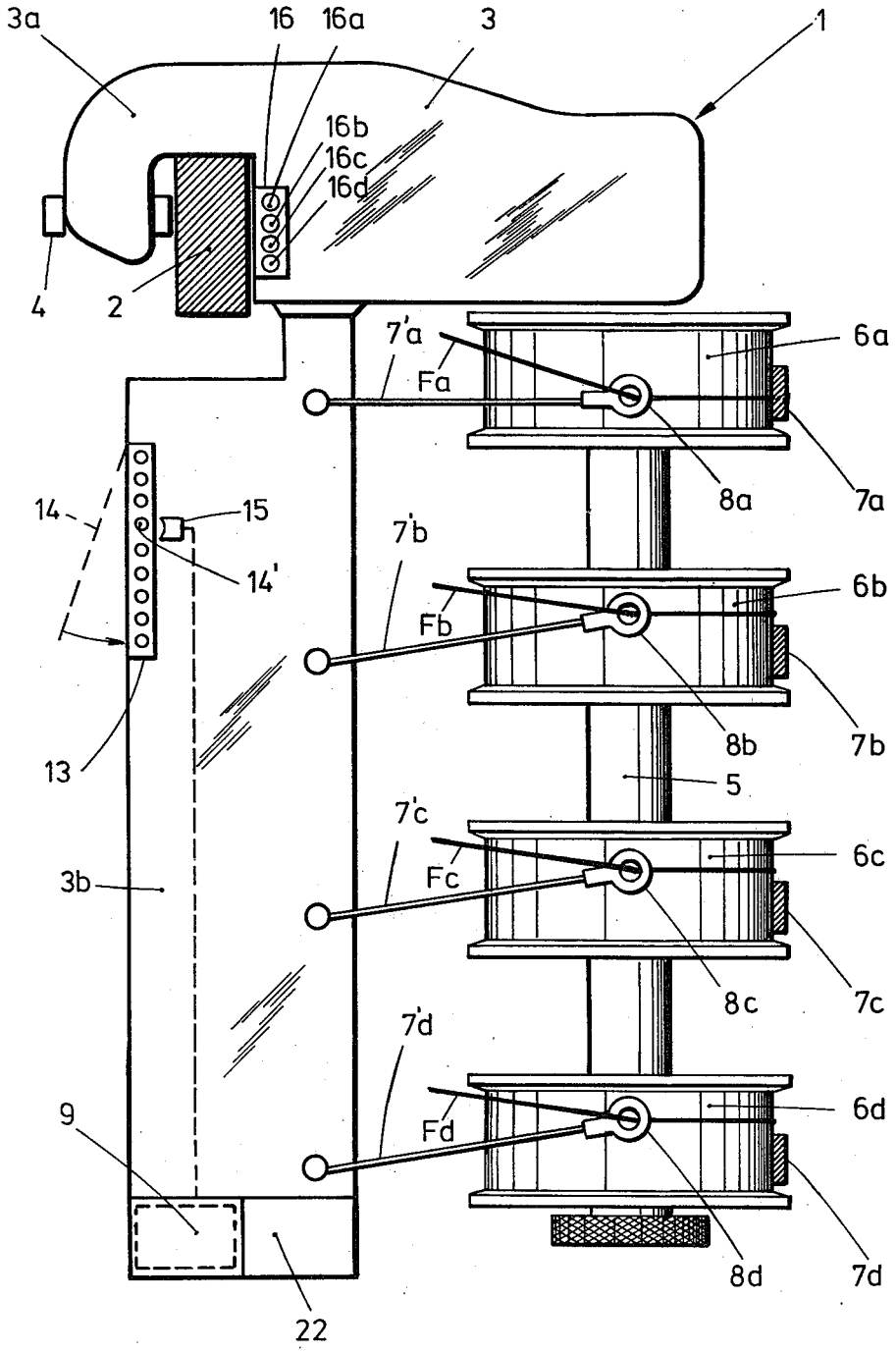

In FIG. 2 a positive feeding unit 1 is fitted on a support ring 2, which in turn is mounted to the frame of a striping knitting machine (not shown) for knitting horizontally striped fabric. There are usually as many units 1 fitted on the machine as there are knitting stations, i.e. one positive feeding unit per knitting station. Each unit 1 has a housing 3 with a hook-shaped portion 3*a* which is placed over the support ring 2 and locked to it by means of a lock screw 4. A vertical shaft 5 is fixed to the housing 3 and carries a plurality of axially spaced feed wheels, known per se, 6*a*–6*d*, which are freely journalled on the shaft 5 by means of ball bearings (not shown in the drawing). The number of the feed wheels corresponds to the number of yarn guides in the striper box so that there in one feed wheel for each yarn, i.e. four yarns and feed wheels in the present case. Four tapes 7*a*–7*d*, driven by the knitting machine drive via a variable diameter pulley (not shown), are guided over a part of the periphery of each feed wheel 6*a*–6*d*.

The housing 3 has another portion 3*b*, which extends vertically and parallel to the shaft 5. Four yarn guide arms 7'*a*–7'*d* with eyelets 8*a*–8*d* are pivotally journalled in the vertical portion 3*b* of the housing 3 and associated with each of the feed wheels 6*a*–6*d* respectively. The vertical portion 3*b* of the housing 3 comprises an electromagnet, designated 9 in FIGS. 2 and 3 which, when energized, changes the vertical position of a vertically displaceable draw bar 10 (schematically shown in FIG. 3), which has spring-loaded pawls (only 10*a* and 10*b* are visible in FIG. 3). When the electromagnet 9 is energized, it pulls the draw bar 10 downwards, whereby the pawls are brought from an upper position to a lower position (shown in dashed lines). Every arm 7'*a*–7'*d* has a counterlever arm 7''*a*, 7''*b*, etc., the free end of which is shaped as a hook.

Four yarns $F_a$–$F_d$ of different colour or otherwise having different properties are guided through the eyelets 8*a*–8*d* respectively and are then guided over a part of the periphery of the feed wheels 6*a*–6*d* respectively. In FIG. 2 yarn $F_a$ is in knitting, whilst the other three yarns $F_b$–$F_d$ are not being knitted for the moment. Arm 7'*a* is in a lower position due to the tension in yarn $F_a$, whilst the other three arms 7'*b*–7'*d* are in an upper position due to the action of a spring (shown schematically in FIG. 3 at 11*a* and *b*). This means that yarn $F_a$ will be guided in between the driven tape 7*a* and the periphery of the feed wheel 6*a* and thus is positively driven over the corresponding yarn guide in the striper box of the knitting machine, while the other three yarns $F_b$–$F_d$ are guided over the part of the periphery of the feed wheels 6*b*–6*d* respectively that is not covered by the driven tape 7*b*–7*d* respectively, which means that these yarns $F_b$–$F_d$ are not being positively fed into the machine.

When the electromagnet 9 is energized (FIG. 3) at the point in time A by a command signal from a central control unit 20 (FIG. 5), driven in synchronism with and by the knitting machine drive, prior to the yarn $F_a$ being taken out of knitting by the corresponding guide in the striper box mechanism, the draw bar 10 is displaced downwards, whereby the pawl 10*a* moves the lever arm 7''*a* downwards by its hook-shaped end. This in turn means that the arm 7'*a* is pivoted upwards so that the yarn $F_a$ is disengaged from the positive feed position between the tape 6*a* and the feed wheel 7*a*. The latter position is shown in dashed lines in FIG. 3. The pawl 10*a* rests on the hook-shaped end of lever arm 7''*a*, thus preventing the yarn tension still present at that moment to pivot the arm 7'*a* back to its lower position.

When the electromagnet 9 is energized the pawls 10*b*–10*d* pass the other arms 7''*b*, etc. Without touching them due to their momentary position outside the reach of these pawls (see FIG. 3).

Figure 4:
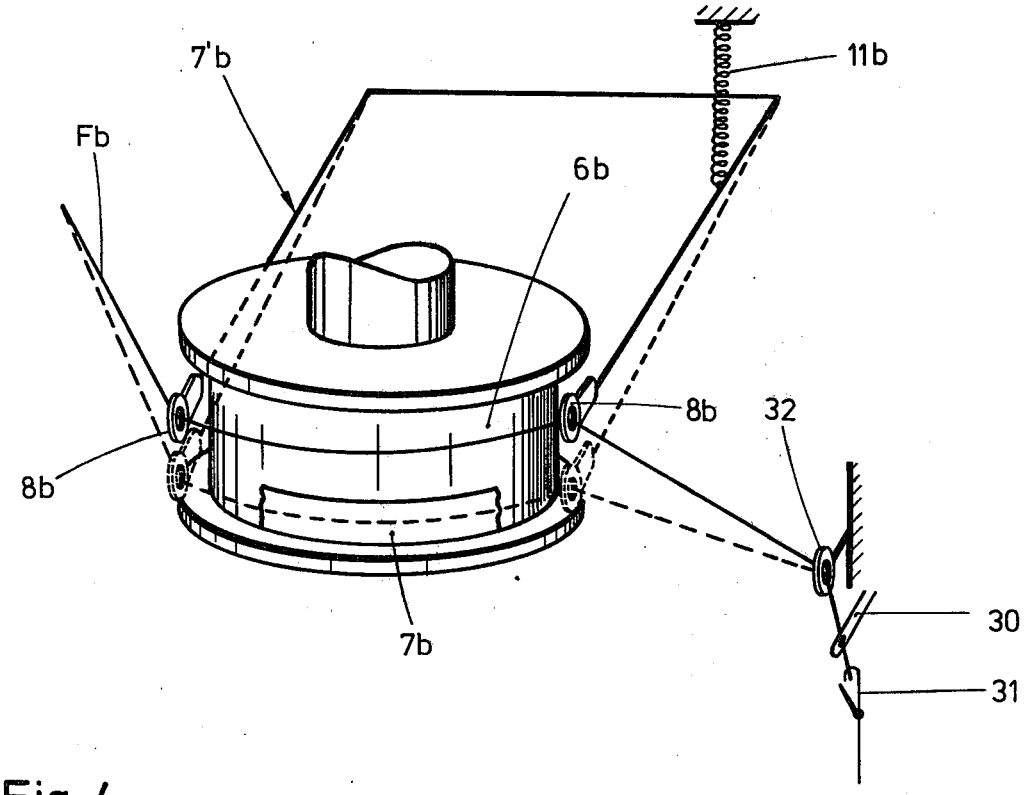
FIG. 4 shows in perspective a simplified view of one of the positive yarn feeding devices of a yarn feeding unit.

Then the yarn $F_b$ is taken into knitting (at a point in time B in FIG. 1) by the corresponding yarn guide in the striper box. How this is accomplished is known in the art and will be explained briefly in connection with FIG. 4, which shows only the yarn feed wheel 6*b*. Each yarn guide arm has the form of a U-shaped bracket with eyelets 8*b* on both free ends and arranged laterally of the yarn feed wheel as shown in FIG. 4. The yarn $F_b$ traverses the eyelets 8*b* and, between them, contacts the surface of the feed wheel 6*b*. After leaving the downstream eyelet 8*b*, the yarn path is inclined downwardly towards a stationary guide eyelet 32 from where the yarn travels to its yarn guide 30 in the striper box and to the knitting needles indicated at 31.

When the yarn guide 30 is in its non-knitting position, there is little tension in the yarn $F_b$ so that the spring 11*b* can pivot the guide arm 7'*b* upwardly. The yarn $F_b$ contacts the yarn feed wheel above the area covered by the drive tape 7*b*. (Solid line position in FIG. 4).

When the yarn guide 30 moves into its knitting position and feeds yarn to the knitting needles, these will pull on the yarn and increase its tension. Due to the downward inclination of the yarn path between the downstream eyelet 8*b* and the stationary eyelet 32, such an increase in yarn tension causes the arm 7'*b* to pivot downwardly against the force of spring 11*b*. This moves the contact area of the yarn on the feed wheel to where the wheel is covered by the drive tape 7*b* (dashed line position) so that positive feeding takes place.

Figure 3:
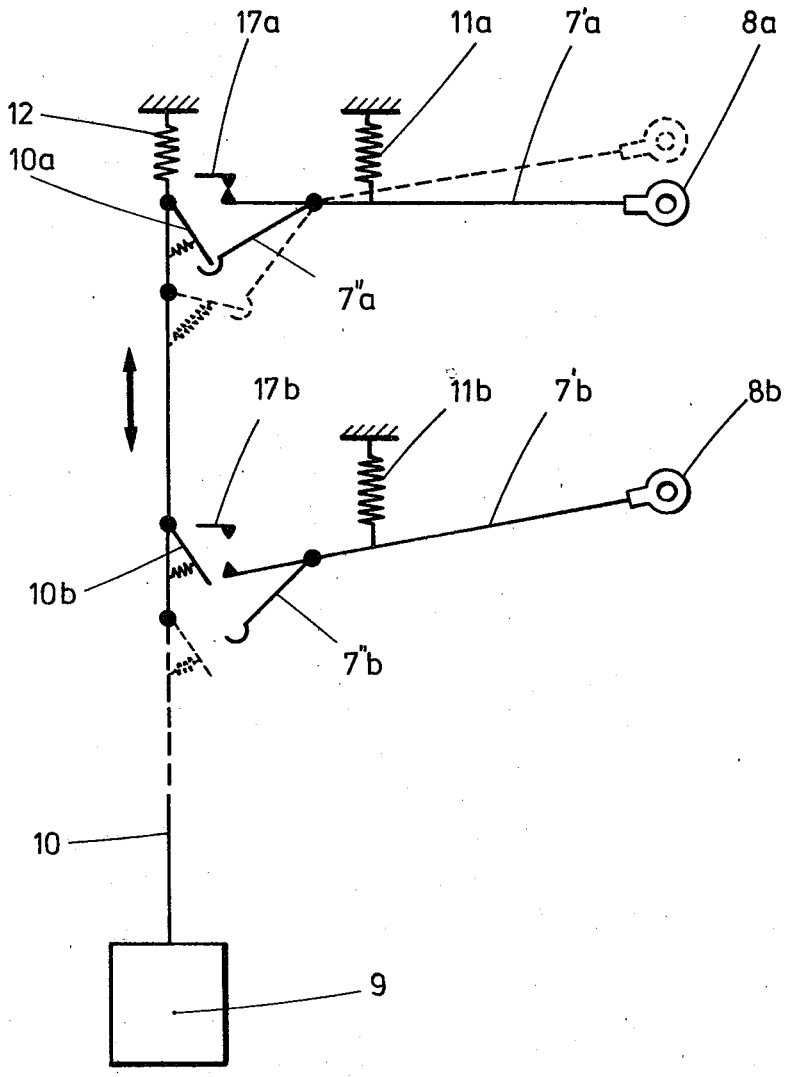
FIG. 3 shows a schematic view of the actuation of the yarn control elements of two of the yarn feeding devices of FIG. 2.

It does not matter, whether the electromagnet 9 is still energized or not at this moment, because, as may be seen from FIG. 3, the lever arm 7''*b* will be able to freely move upwards whether the pawl 10*b* is in its upper or in its lower position.

When the electromagnet 9 is de-energized the draw bar 10 will move upwards again due to the action of a spring 12, whereby all pawls will pass all lever arms 7''*a*, 7''*b*, etc. on their way, without affecting them at all. Also the pawl 10*a* will leave the end of lever arm 7''*a* and will be pivoted to its inward position by its spring. When the next command or energization signal arrives from the central control unit 20 to again energize the electromagnet 9, the arm 7'*b*, being in positive feed position, will now be affected by the pawl 10*b* being moved downwards so that the yarn $F_b$ now is disengaged from the positive feed. Then this procedure is being repeated also for the other two yarns, in a sequence depending on the programmed control of the striper box mechanism.

To sum up from the description above, it is only necessary to issue a command signal from the central control 20—which may comprise a conventional rotation indicator (driven by the machine itself and rotating one revolution per knitting machine revolution) of the optical type, slip ring type or a more advanced electronic memory, a so-called PROM (Programmed Read Only Memory), and which thus generates and issues said command signal to feed unit after feed unit, or in other words to knitting station after knitting station—whenever the respective yarn is station after station is to be disengaged from the positive feed. Engagement of the respective yarn with the positive feed will take place again without any delay, as soon as the consumption of said yarn begins. Thus, no complicated and costly control of the positive feeding devices from the mechanical or electronic pattern mechanism of the knitting machine will be necessary.

FIG. 2 also shows in principle how a flat multi conductor ribbon cable 13 is inserted into the vertical portion 3*b* of the housing 3 inside a hinged cover 14, whereby a contact pin 15, connected to the electromagnet 9 and located at a predetermined position punctures the insulation of the cable and is brought into contact with the corresponding correct conductor 14' in the cable.

FIG. 2 also shows that every set of positive feeding devices is connected in parallel to another flat electrical cable 16 having a current supply conductor 16*b*, a conductor 16*a* for fault indication and stop-motion signal, a start- and reset conductor 16*c* and a ground conductor 16*d*, which all will be described more closely in connection with FIG. 4.

The fault indication function in the apparatus according to the present invention is based on the idea that, as long as one of the arms 7'a–7'd in every yarn feeding unit is in its positive feed position, there is no fault in the system (e.g. yarn breakage, overfeed of yarn, the controlled finger in the striper box drops the yarn to be taken into knitting). However, since every time every arm 7'a–7'd, when being switched over by the electromagnet 9 into its non-positive feed position, reaches a position, where a fault would normally be indicated, it is necessary to block the fault indication signal generated during this moment in order to prevent the knitting machine from stopping every time a yarn is disengaged from the positive feed.

Figure 5:
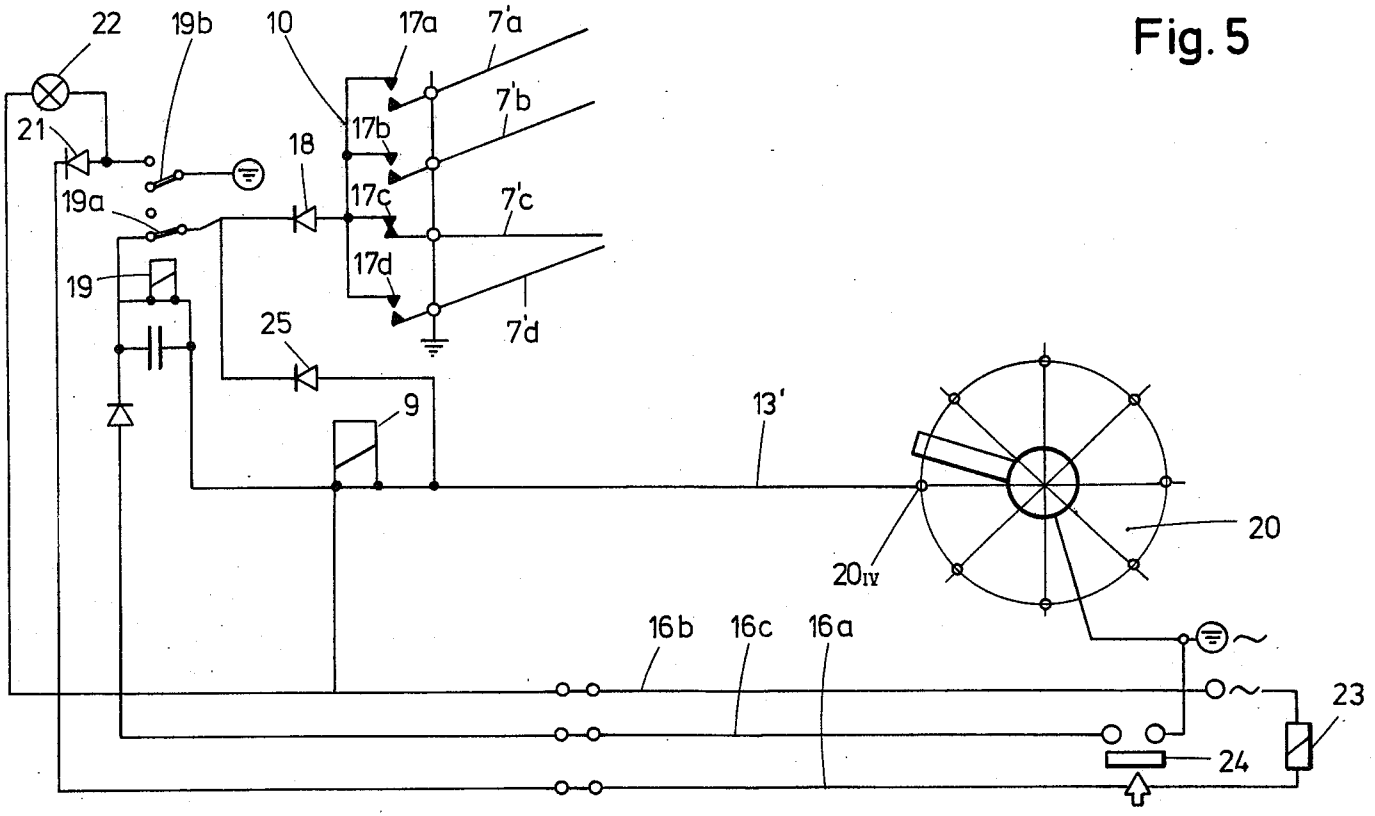
FIG. 5 shows electrical circuitry associated with one yarn feeding unit.

FIG. 5 shows one possible embodiment for achieving this function. There, arm 7'c is in its positive feed position for the moment, whilst the other three arms 7'a, 7'b and 7'd are in the non-positive feed position, i.e. yarn $F_c$ is being knitted. All four arms 7'a–7'd are connected to ground. There are four stop contacts 17a–17d, all of which are connected via a diode 18 to the one contact 19a of a holding relay 19. One of the terminals of this holding relay 19 is connected to the start- and reset conductor 16c, while the other terminal of the relay 19 is connected to the current supply conductor 16b as well as to one terminal of the electromagnet 9. The other terminal of the electromagnet 9 is connected to a control line 13' in the multi-conductor cable, which in turn leads to one contact $20_{IV}$ in the rotation indicator of the central control unit 20. The second contact 19b of the holding relay 19 is connected to the fault indication and stop-signal conductor 16a via a diode 21 and also to the current supply conductor 16b via a fault indicator lamp 22. Designated 23 is a stop-motion relay, i.e. a relay which, when being energized, stops the knitting machine when there is a fault somewhere in the system.

When starting the knitting machine, the machine operator closes a spring-loaded switch 24 in the start- and reset conductor 16c, whereby the holding relay 19 will be energized and closes its contact 19a. Thereafter, as long as one of the arms 7'a–7'd is in its positive feed position, which is the case under normal operating conditions. current will flow through the holding relay 19 from the current supply conductor 16b to the ground connection of the respective arm being in positive feed position. This current flow through relay 19 is also maintained when the electromagnet 9 is energized in order to disengage one of the four yarns from positive feed, since current will then flow from one of the terminals of the electromagnet 9 through the relay 19 and via a diode 25 to switch $20_{IV}$ of the rotation indicator, which is connected to ground during this moment. Thus, there will be no current flowing through the fault-indication conductor 16a to the stop-motion relay 23 during this moment.

However, when a fault occurs somewhere in the system, e.g. there is a slack in the yarn being positively fed, the corresponding arm 7'a–7'd will at least momentarily move over to its non-positive feed position, its switch 17a–17d will be opened and current will cease to flow through relay 19. Thereby, the second contact 19b of the relay 19 will connect the stop signal conductor 16a to ground and thus stop-motion relay 23 will be energized to stop the knitting machine. Also, the indicator lamp 22 will receive current from the conductor 16b and light up to indicate where the fault has occurred.

After repairing the fault in the system, the machine operator closes the switch or button 24 in the reset conductor 16c, whereby the holding relay 19 is again energized and contact 19b is again opened.

The present invention is not limited to the embodiment described above and shown in the drawings, but several other embodiments are possible within the scope of the following claims. E.g., it would be possible to reverse the action of electromagnet 9 by having the spring (which would then be a compression spring) move the draw bar 10 into its lower position in FIG. 3, while the electromagnet would return it into its upper position. This embodiment would, however, have the disadvantage that the electromagnet would have to be energized most of the time.

Instead of spring-loaded pawls 10a, 10b, 10c, 10d, cams rigidly attached to the draw bar 10 or slots in the draw bar could be used to pull the lever arms 7''a, 7''b, etc. downwardly. The electromagnet would remain energized during the time interval AC and maintain all arms 7'a–7'd in their second positions. After de-energization of the magnet the spring 12 would move the draw bar 10 back upwardly, thus releasing all lever arms 7''a, 7''b, etc. and permitting of the yarn tension to move the arm associated with the yarn to be knitted into its first position. Such an arrangement would be mechanically simple, but would render the overlap BC impossible. It would, however, maintain the advantage that the release of positive feeding can be accomplished prior to the yarn being taken out of knitting.

Instead of using individual switches 17a–17d for each yarn feeding device, a common switch associated with a part moved to one position by at least one of the control elements being in the first position and to a second position when all control elements are in their second position could be used. Such a switch would then only produce a disturbance signal when all control elements are in their second position. The disturbance signal would be suppressed in the manner described when the electromagnet 9 is energized. The part mentioned could be a modified draw bar which is moved upwardly by the yarn control elements themselves upon their movement into the first position.

I claim:

1. Apparatus for selective positive feeding of a plurality of yarns (Fa; Fb; Fc; Fd) to a horizontal striping knitting machine, said knitting machine comprising a number of knitting stations, each having a striper box mechanism including a set of movable yarn guides (e.g. 30) controllable for selectively taking yarn after yarn into resp. out of the knitting position relative to the knitting needles (e.g. 31), a number of positive yarn feeding units corresponding to the number of knitting stations being provided, each having a set of positive yarn feeding devices corresponding to the number of yarn guides in each set, with which the yarns are selectively engageable in a first position to be fed positively to the corresponding yarn guide or disengageable in a second position by means of yarn control elements (7'a, 7''a, 8a; 7'b, 7''b, 8b; 7'c, 8c; 7'd, 8d), and electromagnetically controlled yarn control means being associated with said yarn feeding control elements to move said yarns from their first to their second positions prior to their being taken out of the knitting position by the yarn guides, characterized in that a single electromagnet (9) is associated with each set of yarn feeding devices (6a, 7a; 6b, 7b; 6c, 7c; 6d, 7d), which, when energized, moves any of said yarn control elements being in its first position to its second position via a uni-directional coupling means (10a, 7''a; 10b, 7''b, etc.) not permitting of moving of each yarn control element to its first position by the de-energization of the electromagnet (9), and that each yarn (Fa; Fb; Fc; Fd) together with its associated yarn control element is movable, in a manner known per se, from its second position to its first position by an increase in its tension due to its being brought into knitting position by its associated yarn guide.

2. Apparatus according to claim 1, characterized in that the electromagnet (9) acts on a spring-loaded draw bar (10), the uni-directional coupling means consisting of spring-loaded pawls (10*a;* 10*b;* etc.) on the draw bar (10) and of arms (7″*a;* 7″*b;* etc.) of the yarn control elements engaged by the pawls only when they are in their first positions and only during and at the end of the movement of the draw bar caused by energization of the electromagnet.

3. Apparatus according to claim 2, characterized in that the arms (7″*a;* 7″*b;* etc.) have hook-shaped ends cooperating with the free ends of the pawls (10*a;* 10*b;* etc.).

4. Apparatus according to one of claims 1 to 3, characterized in that a control circuit comprising an indicator lamp (22), a stop-motion relay (23) and a control line (13) leading from a central control unit (20) to the electromagnet (9) is associated with each set of yarn feeding devices (6*a,* 7*a;* 6*b,* 7*b;* 6*c,* 7*c;* 6*d,* 7*d*), said control circuit being closed only when the control line (13′) is de-energized and when switching means (17*a*–17*d*), being comprised in the control circuit and associated with said yarn control elements (7′*a,* 7″*a,* 8*a;* 7′*b,* 7″*b,* 8*b;* 7′*c,* 8*c;* 7′*d,* 8*d*), are in a state corresponding to all yarn control elements being in their second position.

5. Apparatus according to claim 4, characterized in that the control circuit comprises a self-holding relay (19), the self-hold current of which flows through the switching means (17*a;* 17*b;* 17*c;* 17*d*) and/or through the control line (13′).

* * * * *

UNITED STATES PATENT AND TRADEMARK OFFICE

CERTIFICATE OF CORRECTION

PATENT NO. : 4 386 508

DATED : June 7, 1983

INVENTOR(S) : Kurt A.G. Jacobsson

It is certified that error appears in the above-identified patent and that said Letters Patent is hereby corrected as shown below:

Col. 1, between lines 4 and 6; insert the subheading
---FIELD OF THE INVENTION---.
line 8; delete "in accordance with the pream-".
line 9; delete "ble of claim 1".
between lines 9 and 10; insert the subheading
---BACKGROUND OF THE INVENTION---.
line 65; change "claim 1" to ---the claims---.

Col. 2, lines 12-19; delete in their entirety.
between lines 19 and 20; insert the subheading
---BRIEF DESCRIPTION OF THE DRAWINGS---.
between lines 37 and 38; insert the subheading
---DETAILED DESCRIPTION---.
line 47; delete the comma.

Col. 3, line 26; change "b" to ---11b---.
line 50; change "to" (first occurrence) to ---from---.
change "pivot" to ---pivoting---.

Col. 4, line 16; delete the comma.
line 17; delete the comma, (first occurrence).
line 68; change "4" to ---5---.

Col. 5, line 10; delete the comma (first occurrence).

Col. 6, line 44; delete "(Fa; Fb; Fc; Fd)".
line 47; delete "(e.g.".

UNITED STATES PATENT AND TRADEMARK OFFICE

CERTIFICATE OF CORRECTION

PATENT NO. : 4 386 508

DATED : June 7, 1983

INVENTOR(S) : Kurt A.G. Jacobsson

It is certified that error appears in the above-identified patent and that said Letters Patent is hereby corrected as shown below:

Col. 6, line 48; delete "30)".
line 49; change "resp." to ---and---.
line 50; delete "(e.g. 31)".
line 52; delete "being provided".
after "each" insert ---unit---.
line 57; delete "(7'a,".
line 58; delete "7''a, 8a; 7'b, 7''b, 8b; 7'c, 8c; 7'd, 8d)".
line 59; delete "being".
line 63; delete "(9)".
line 64; delete "(6a,".
line 65; delete "7a; 6b, 7b; 6c, 7c; 6d, 7d)".
line 68; delete "(10a, 7''a; 10b, 7''b, etc.)".
Col. 7, line 2; delete "(9)".
line 3; delete "(Fa; Fb; Fc; Fd)".
line 10; delete "(9)".
line 11; delete "(10)".
line 12; delete "(10a; 10b; etc.)".
line 13; delete "(10)".
delete "(7''a; 7''b; etc.)".
line 20; delete "(7''a; 7''b; etc.)".
Col. 8, line 1; delete "(10a; 10b;".
line 2; delete "etc.)".

UNITED STATES PATENT AND TRADEMARK OFFICE

CERTIFICATE OF CORRECTION

PATENT NO. : 4 386 508

DATED : June 7, 1983

INVENTOR(S) : Kurt A.G. Jacobsson

It is certified that error appears in the above-identified patent and that said Letters Patent is hereby corrected as shown below:

Col. 8, line 3; after "to" insert ---any---.

line 5; delete "(22)".

delete "(23)".

line 6; delete "(13)".

delete "(20)".

line 7; delete "(9)".

line 8; delete "(6a, 7a; 6b, 7b; 6c, 7c; 6d, 7d)".

line 9; delete "(13')".

line 10; delete "(17a-17d)".

line 12; delete "(7'a, 7''a, 8a; 7'b, 7''b, 8b; 7'c, 8c;".

line 13; delete "7'd, 8d)".

line 17; delete "(19)".

line 18; delete "(17a; 17b; 17c; 17d)".

line 19; delete "(13')".

Signed and Sealed this

Twentieth Day of March 1984

[SEAL]

*Attest:*

GERALD J. MOSSINGHOFF

*Attesting Officer*

*Commissioner of Patents and Trademarks*